US008616261B2

(12) United States Patent
Miller

(10) Patent No.: US 8,616,261 B2
(45) Date of Patent: Dec. 31, 2013

(54) SHUTTER SLAT END RETENTION SYSTEM

(75) Inventor: James V. Miller, Glen Ellyn, IL (US)

(73) Assignee: Qualitas Manufacturing Inc., Itasca, IL (US)

( * ) Notice: Subject to any disclaimer, the term of this patent is extended or adjusted under 35 U.S.C. 154(b) by 475 days.

(21) Appl. No.: 11/445,005

(22) Filed: Jun. 1, 2006

(65) Prior Publication Data

US 2007/0277939 A1 Dec. 6, 2007

(51) Int. Cl.
*E06B 9/08* (2006.01)

(52) U.S. Cl.
USPC ..... 160/133; 160/183; 160/118

(58) Field of Classification Search
USPC ..... 160/32, 35, 36, 133, 183, 371, 271, 160/272, 273.1
See application file for complete search history.

(56) References Cited

U.S. PATENT DOCUMENTS

| | | | | |
|---|---|---|---|---|
| 1,302,093 | A * | 4/1919 | Shomaker | 160/118 |
| 3,156,294 | A * | 11/1964 | Miller et al. | 160/173 R |
| 3,670,797 | A * | 6/1972 | Sassano | 160/118 |
| 4,732,201 | A * | 3/1988 | Dillitzer | 160/25 |
| 4,738,296 | A * | 4/1988 | Hatch | 160/133 |
| 5,068,861 | A * | 11/1991 | Abbott et al. | 372/20 |
| 5,172,742 | A * | 12/1992 | Iwasaki et al. | 160/36 |
| 5,377,738 | A * | 1/1995 | Cooper | 160/133 |
| 5,682,937 | A * | 11/1997 | Decrane et al. | 160/133 |
| 5,839,493 | A * | 11/1998 | Quasius | 160/133 |
| 6,095,225 | A * | 8/2000 | Miller | 160/133 |
| 6,422,289 | B1 * | 7/2002 | Miller | 160/133 |
| 6,527,037 | B2 * | 3/2003 | Daus et al. | 160/315 |
| 6,615,896 | B1 * | 9/2003 | Andalia | 160/183 |
| 6,631,749 | B1 * | 10/2003 | Zabala | 160/133 |
| 6,659,158 | B2 * | 12/2003 | Laugenbach | 160/270 |
| 6,715,529 | B2 * | 4/2004 | Farooq | 160/133 |
| 6,755,231 | B1 * | 6/2004 | Biggers | 160/183 |
| 6,918,343 | B2 * | 7/2005 | Kester | 111/195 |
| 6,951,236 | B2 * | 10/2005 | Schlater et al. | 160/133 |
| 7,100,665 | B2 * | 9/2006 | Miller | 160/235 |
| 7,111,661 | B2 * | 9/2006 | Laugenbach | 160/270 |
| 7,121,316 | B2 * | 10/2006 | Biggers | 160/183 |
| 7,357,171 | B2 * | 4/2008 | Miller | 160/235 |
| 7,409,980 | B1 * | 8/2008 | Heissenberg | 160/133 |
| D631,171 | S * | 1/2011 | Konrad | D25/48.4 |
| 2003/0024659 | A1 * | 2/2003 | Begni | 160/235 |
| 2003/0077932 | A1 * | 4/2003 | Lewinnek | 439/246 |

(Continued)

OTHER PUBLICATIONS

Alulux Product Description Sheet (2 pages).

*Primary Examiner* — Katherine Mitchell
*Assistant Examiner* — Candace L Bradford
(74) *Attorney, Agent, or Firm* — Ice Miller LLP

(57) ABSTRACT

An end retention system for a rolling shutter system is provided. The end retention system comprises a fastener that has a head and a shaft, and a washer that has an outer diameter and an aperture having an inner diameter. The inner diameter of the aperture of the washer is at least twice the diameter of the shaft of the fastener. The shaft is configured for insertion into a screw boss receptacle of a shutter slat. The end retention system may also comprise a guide track that has retention fins spaced apart a distance that is less than the outer diameter of the washer. The guide may include a channel that partially bounded by the retention fins. The channel may have a width that is greater than the outer diameter of the washer. The washer is located in the channel, and is retained near the slat by the head of the fastener.

26 Claims, 11 Drawing Sheets

(56) References Cited

U.S. PATENT DOCUMENTS

| | | | | |
|---|---|---|---|---|
| 2004/0226668 | A1* | 11/2004 | Biggers | 160/183 |
| 2005/0045280 | A1* | 3/2005 | Schlater et al. | 160/133 |
| 2005/0205223 | A1* | 9/2005 | Miller | 160/236 |
| 2005/0247246 | A1* | 11/2005 | Kester | 111/193 |
| 2007/0221341 | A1* | 9/2007 | Schanz | 160/133 |
| 2008/0245489 | A1* | 10/2008 | Chuang et al. | 160/236 |
| 2012/0055637 | A1* | 3/2012 | Marinetti et al. | 160/133 |
| 2012/0090793 | A1* | 4/2012 | Beulen | 160/133 |

* cited by examiner

Prior Art

Prior Art

Prior Art

SHUTTER SLAT END RETENTION SYSTEM

BACKGROUND OF THE INVENTION

The present invention relates to shutters and in particular to shutters of the roller type. It furthermore relates to an end retention system for use with a slat of a rolling shutter.

DESCRIPTION OF THE RELATED ART

Conventional roller shutters are designed to provide security from break-ins and protection from storms. Because such protection and security may not always be necessary or desired, such as during the day when a retail store is open for business or during fine weather when a homeowner wishes to open windows, roller shutters are designed to be retractable into a casing in which they are stored. To facilitate compact storage, the rigid shutter slats that are designed to resist hurricane winds and burglars must be capable of conforming to a roll.

The slats of roller shutters are commonly aligned and held in place by guides, or side tracks. End retention systems are known for use in rolling shutters and doors to keep the shutter curtain engaged in the side tracks during pressure caused by winds, or by would-be intruders attempting to force the shutters open. Several types of end retention systems are known in the art. Some of these systems change the diameter of the roll at the spot where the end retention system has been placed. Special tracks have been designed to provide special channels for end retention systems so that the end retention system does not change the rolled curtain configuration at these points where the end retention system is installed.

These special tracks may be undesirable because they may require special channels that limit the amount of horizontal travel, or "slip" (travel in the plane of the shutter that is perpendicular the direction of opening and closing of the shutter, which is usually vertical) the shutter curtain has in its operation. This limited amount of slip increases the pressure on the fastening system that holds the guides to the structure caused by catenary forces established when the curtain is put under load. It may be desirable to increase the amount of slip that the shutter curtain can absorb before the load is transferred to the fasteners due to the retention of the shutter slats.

Another drawback of the channels of these special tracks is that they may increase the necessary sophistication of the overall shutter design to allow for funneling the end retention system into the channels and for keeping the shutter curtain correctly aligned. Typically, the end retention system has an end that is no wider than the width of the profile of the slats of the shutter, so that there is no change in the rolled configuration. To accommodate this, the diameter of the end retention system may be reduced to allow for the system to move in the void between the end retention fins of the side tracks.

One simple end retention system of this type is a screw that fastens into the shutter curtain profile, for example to the side of a slat, and extends beyond the end retention fins of the side track. The screw may have a large head that is roughly equal to the width of the curtain profile (which is generally the same as the width of the profile of a single slat) so it is not so large as to increase the diameter of the rolled curtain, but large enough that it will be held captive by the end retention fins of the side track.

One problem that may arise with this type of end retention system is that a moment may be created in the screw (fastener), because it extends from the curtain profile and may act as a lever. If the end retention system happens to be out of line or catches on the retention fins of the side tracks or something else, the system can be bent or torn out and can cause a malfunction of the operation of the shutter curtain. To increase the desired slip in a system using special tracks, the channel sizes may need to be increased, which requires more material, and may also increases the possibility of failure due to increased moment of the longer shaft.

It may be desirable to maximize the engagement between the end retention fins and the end retention system. Many known end retention systems limit the end retention system's size to be no wider than the curtain profile depth, so that the retention system does not engage an adjacent profile or an adjacent profile's end retention system when the shutter curtain is rolled up. These types of end retention systems, however, may limit the amount of engagement between the end retention fins and the end retention system.

If the desirable level of engagement is attained, it may be possible to reduce the number of end retention systems used in a shutter curtain. Instead of using an end retention system in every slat, for example, it may be possible to only install an end retention system in every other slat, every third slat, or the like, and still achieve a desired strength. Systems that attain this increased engagement are referred to herein as "increased engagement end retention systems."

One known increased engagement end retention system is the Alulux CD41/S end retention system, which is configured to be inserted into the hollow profiles of a number of slats in a shutter curtain. This end retention system has a shape such that if one system interferes with an adjacent system when the shutter curtain is rolled up, the system will slide off of the adjacent system, realigning the curtain. This resulting movement of the shutter slats can put undo force on these systems, and may be undesirable because it could loosen or dislodge the end retention system. One could calculate which end retention system is likely to engage another in a given shutter design, and could extend some systems so they do not engage adjacent ones. This extension may be undesirable, however, because it difficult to insure the correct systems are extended, and because the systems may not all engage the retention fins uniformly when the shutter is put under a load. Such a system also may not be a good solution for single wall shutter profiles, because of the limited shutter curtain profile width and lack of interior cavity make affixing such an end retention system difficult.

Another increased engagement end retention system is the ALULUX CD 77/2 system, which slips out of the way of an adjacent system when the shutter curtain is rolled up. This system only lets the end retention system slide in one plane. This system uses multiple points of engagement or tracks to maintain the movement on this desired plane.

This ALULUX CD 77/2 increased engagement end retention system has an increased engagement because the system is wider than the width of the curtain profile. This end retention system can be used with a less complex side track system; such as such as the ALULUX UP 250/S, to retain the shutter profile in the side track. This arrangement may allow for an increase in the desired slip without changing the shape of the side tracks, since the end retention system is wider than the width of the curtain profile when in the side tracks. Also because this end retainer system is adjacent to the curtain profile it significantly reduces the moment put on the attachment system to the curtain profile making it stronger and less prone to failure. However, this end retention system achieves these benefits by its increased size, and therefore suffers from the problems described above regarding large end retention systems.

Generally, the use of end retention systems may allow for the use of smaller and thinner curtain profiles to attain desirable resistances to pullout. These smaller and thinner curtain profiles are desirable because they require less material to manufacture, they are able to roll up in a smaller diameter requiring less material to house the rolled shutter, and they reduce the torque required to operate the shutter due to the decreased overall weight of the shutter curtain. However, increased engagement end retention systems generally are not easily inadaptable for use with these thinner profile shutter curtains. It would be desirable to provide an increased engagement end retention system that is adapted for use with thinner (single walled) shutter curtains.

SUMMARY OF THE INVENTION

An end retention system for a rolling shutter system is provided. The end retention system comprises a fastener that has a head and a shaft, and a washer that has an outer diameter and an aperture having an inner diameter. The inner diameter of the aperture of the washer may be at least twice the diameter of the shaft of the fastener. The shaft may be configured for insertion into a screw boss receptacle of a shutter slat.

The end retention system may also comprise a guide track that has a retention fins spaced apart a distance that is less than the outer diameter of the washer. The guide may include a channel that is partially bounded by the retention fins. The channel may have a width that is greater than the outer diameter of the washer. The washer is located in the channel, and is retained near the slat by the head of the fastener.

The fastener may have a second shaft, which is smooth. Additionally, the fastener may have a lip, where the lip is located between the first and second shafts. The lip may facilitate the alignment of the shutter slat with an adjacent shutter slat in the rolling shutter system.

Additional features of the present invention will become apparent to those skilled in the art upon consideration of the following detailed description of preferred embodiments exemplifying the best mode of carrying out the invention as presently perceived.

BRIEF DESCRIPTION OF THE DRAWINGS

Embodiments of the invention will now be explained in further detail by way of example only with reference to the accompanying figures, in which.

DETAILED DESCRIPTION

Figure 1:
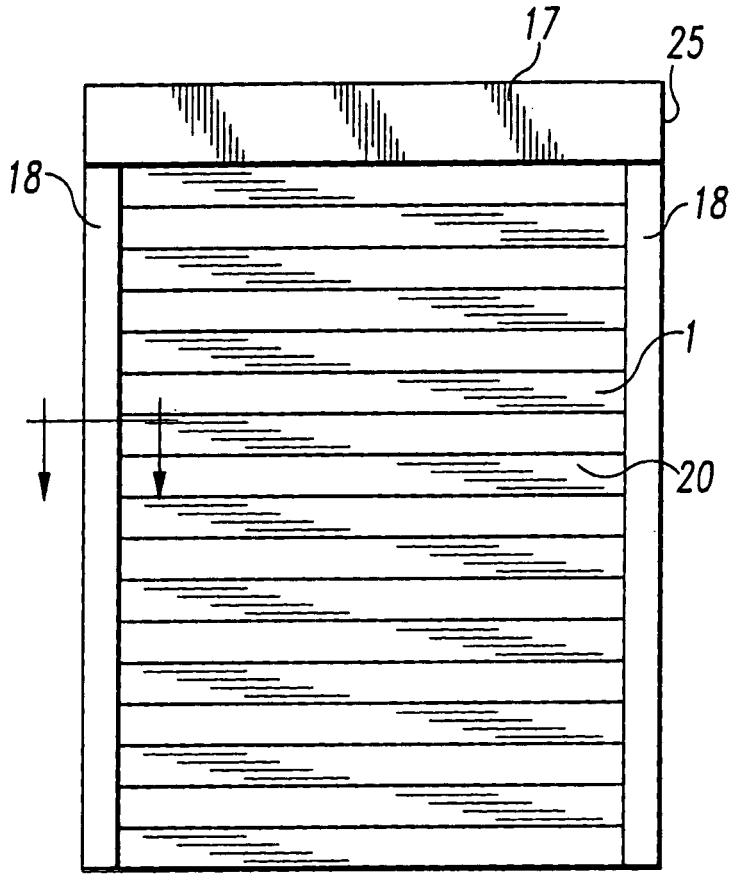
FIG. 1 is an elevation view of a window aperture including an illustrative shutter.

FIG. 1 shows an illustrative roller shutter 20 (shutter curtain) installed on a building aperture 25, such as a window or a door. The building aperture 25 may be further equipped with a shutter casing 17 and guides 18. The guides 18 may be located on opposite lateral edges of the building aperture 25. The roller shutter 20 may be rolled up for storage within the shutter casing 17.

Figure 2:
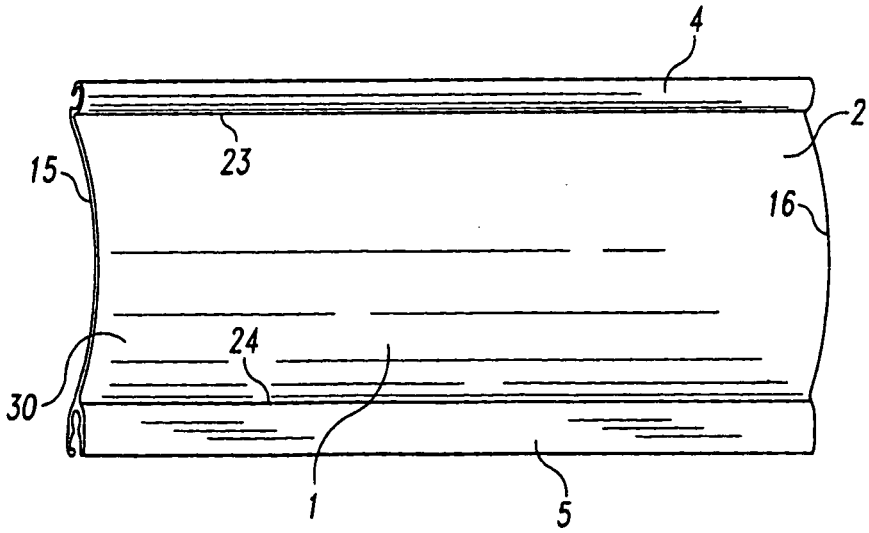
FIG. 2 is an elevation view of an illustrative shutter slat.
Figure 10:
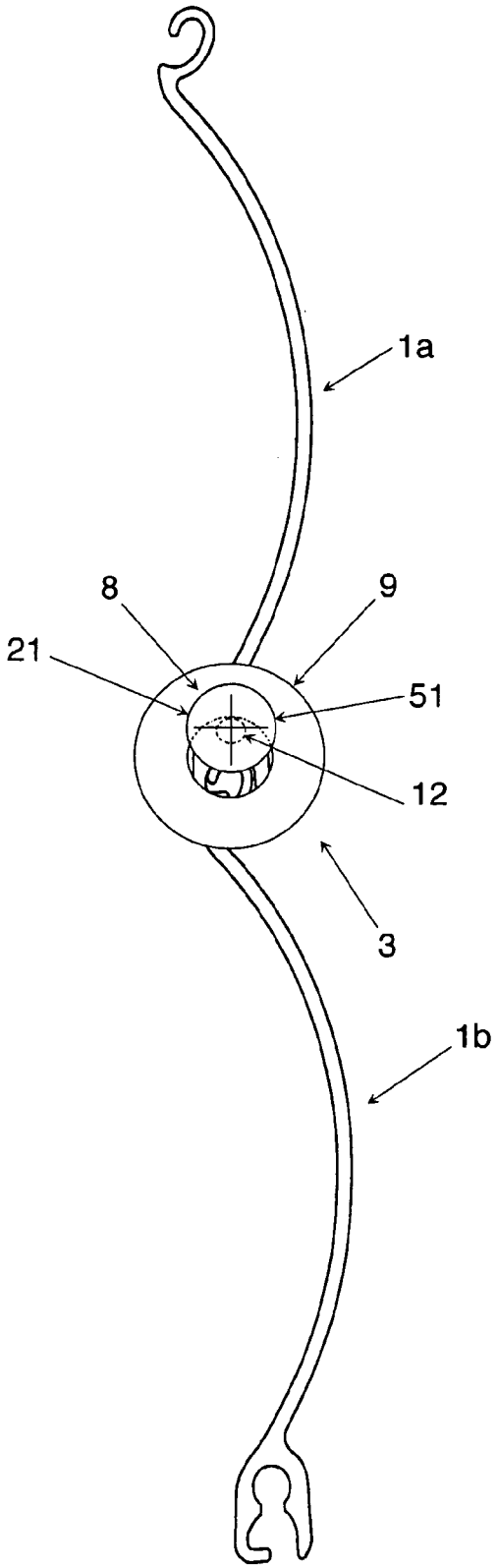
FIG. 10 is a detailed side view of the two illustrative shutter slats of FIG. 3 with an end retention system coupled to one of the shutter slats.

FIG. 2 shows an illustrative shutter slat 1, a plurality of which is shown in the roller shutter 20 in FIG. 1. Illustratively, the shutter slat 1 is an elongated body of single-ply extruded aluminum having a first end 15 and a second end 16, a body portion 30 bounded by an upper edge 23 and a lower edge 24, and an engaging track 4 and a receptacle track 5. The first and second ends 15 and 16 of the shutter slat 1 may be adjacent the guides 18 shown in FIG. 1. A retention system 3, as shown in FIG. 10, may provide for a secure alignment of the ends 15 and 16 with the guides 18.

Figure 3:
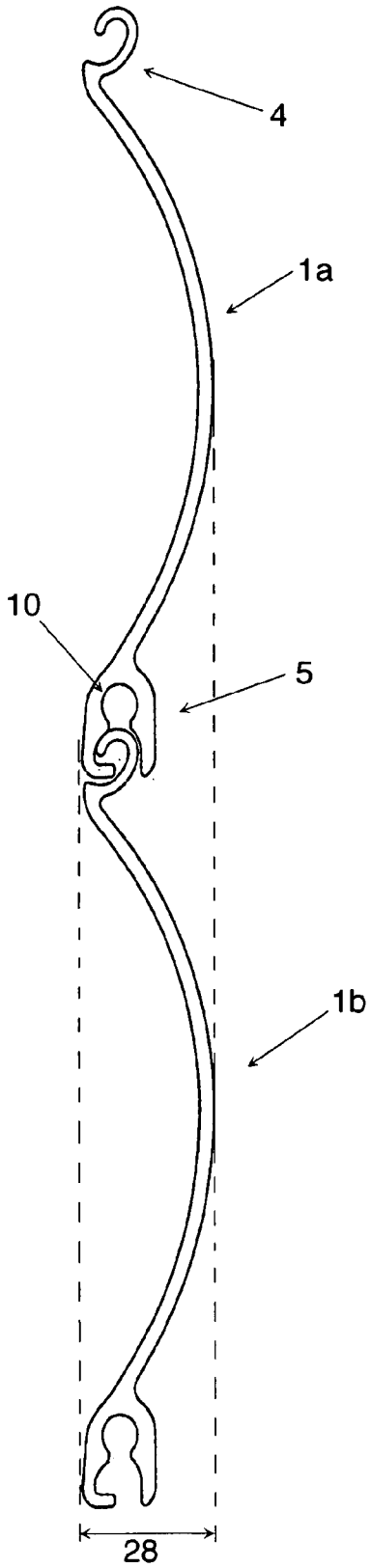
FIG. 3 is a side view of two illustrative shutter slats, as shown in FIG. 2.

FIG. 3 is a detailed side view of two shutter slats 1*a* and 1*b* engaged with one another, for example as the shutter slats are engaged in roller shutter 20 of FIG. 1. Each shutter slat 1*a* and 1*b* has an engaging track 4, a receptacle track 5, and a boss receptacle 10 (screw receptacle). The boss receptacle 10 is adapted to receive a retention screw 8 (shown in FIG. 10). FIG. 3 shows the engaging track 4 of the slat 1*a* engaging receptacle track 5 of the slat 1*b*. The slats 1*a* and 1*b*, and consequently the profile of the shutter curtain 20, have a profile width 28.

Figure 4:
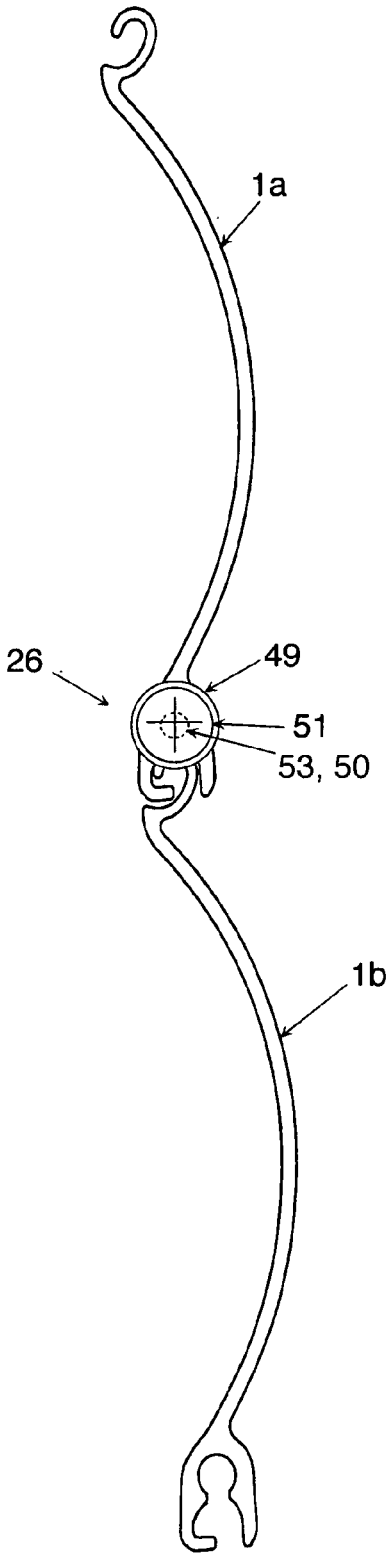
FIG. 4 is a detailed side view of the two illustrative shutter slats of FIG. 3 with a first prior art end retention system coupled to one of the shutter slats.
Figure 5:
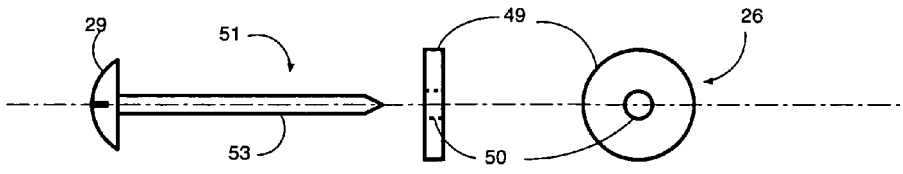
Fig. 5 Prior Art
FIG. 5 is a detailed view of the first prior art end retention system of FIG. 4.

FIG. 4 is a detailed side view of the two shutter slats 1*a* and 1*b* engaged with one another, and having a prior art end retention system 26 installed. The retention system 26 comprises a screw 51 and a washer 49. The prior art end retention system 26 is shown in greater detail in FIGS. 5 and 6. As shown in FIG. 5, the prior art end retention system includes a screw 51 inserted into an aperture 50 of a washer 49. The diameter of the aperture 50 is about the same as the diameter of the shaft 53 of the screw 51. The outer diameter of the washer 49 is about the same as the diameter of a head 29 of the screw 51.

Figure 6:
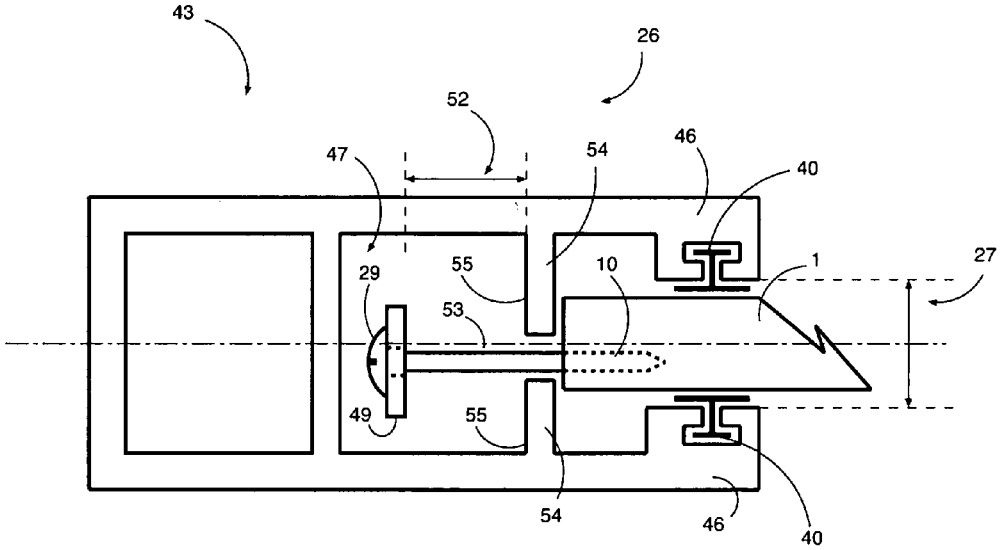
FIG. 6 is a detailed sectional view of a first prior art guide engaged by the shutter slat and the first prior art end retention system of FIG. 4.

FIG. 6 is a detailed sectional view of a prior art guide 43 engaged by the shutter slat 1 and prior art end retention system 26. The prior art guide 43 includes first end retention fins 46 that are separated apart by a distance 27 that is greater than the profile width 28 of the of the shutter slat 1. The first end retention fins 46 include weather strips 40. The prior art guide 43 also includes second end retention fins 54 that partially bound a first channel 47, and have inner retaining surfaces 55 that serve to retain the end retention system 26 within the first channel 47.

The prior art end retention system 26 may be coupled to the shutter slat 1 for use with the prior art guide 43 by inserting the screw 51 into the boss receptacle 10. The head 29 of the retention screw 51 retains the washer 50 near the shutter slat 1. Because the washer 49 is wider than the distance that separates the second retention fins 54, the retention system 26 retains the shutter slat 1 within the first channel 47.

In the prior art end retention system 26, the shaft 53 of the screw 51 extends a distance 52 from inner retaining surfaces 55 of second retention fins 54 in order to allow for a desirable amount of horizontal slide (in the right-left directions in FIG. 6) of the slat 1. However, allowing for slide by extending the shaft 53 away from the slat 1 allows for the creation of a moment force on the screw 51 if the washer 49 or the screw 51 should happen to be out of line with the guide 43 or catch on the retention fins 54. When this occurs, the screw 51 could be bent or torn out of the boss receptacle 10, which could cause a malfunction of the operation of the shutter curtain 20.

Additionally, in order to retain the slat 1 between the first retention fins 46 in this prior art system, it is necessary to include the second retention fins 54. This is because the first retention fins 46 are "centered" with respect to slat 1 (and with respect to the guide 43), while the boss receptacle 10 and the screw 51 coupled thereto are offset with respect to the center of the slat 1. If the second retention fins 54 were removed, and the shaft 53 of the screw 51 were shortened so that the washer 49 was against the end of the slat 1, then force exerted on the slat 1 (such as the force created by wind) would tend to pull the washer 49 through the space between the retention fins 46. Additionally, as shown in FIG. 6, the outer diameter of the washer 49 is about the same as the width of the slat 1, so that the washer 49 would not be retained in the guide 18 if the second retention fins 54 were removed, because the distance 27 between the first retainer fins 46 is about the same or greater than the diameter of the washer 49.

Because the screw 51 is offset with respect to the center of the slat 1, the outer diameter of the washer 49 cannot be simply increased to compensate for this tendency, because the offsetting limits the outer diameter of the washer 49 to the distance from the screw shaft 53 to the closer wall of the guide 43. It would be desirable to eliminate the need for the second retention fins 54 and provide an end retention system that does not require extending the screw shaft 53 away from the slat 1, while not increasing the likelihood that the washer 49 will be pulled into the space between the first retention fins 46.

Figure 7:
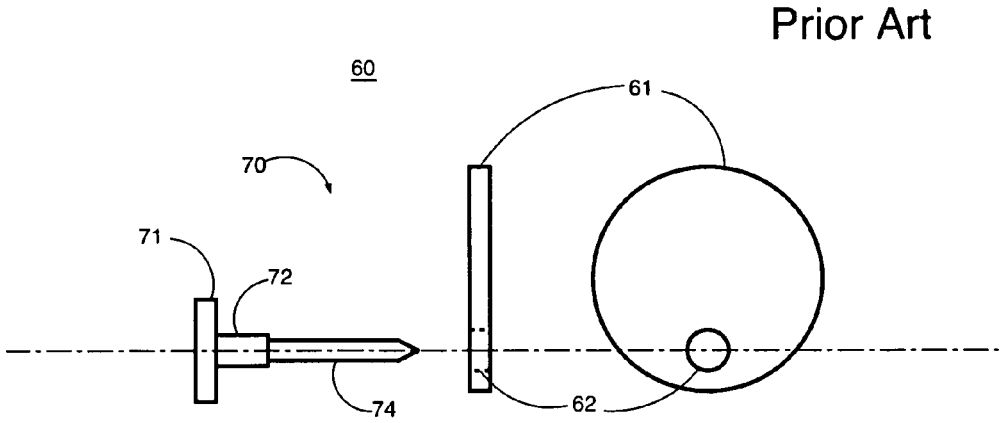
FIG. 7 is a detailed view of a second prior art end retention system
Figure 8:
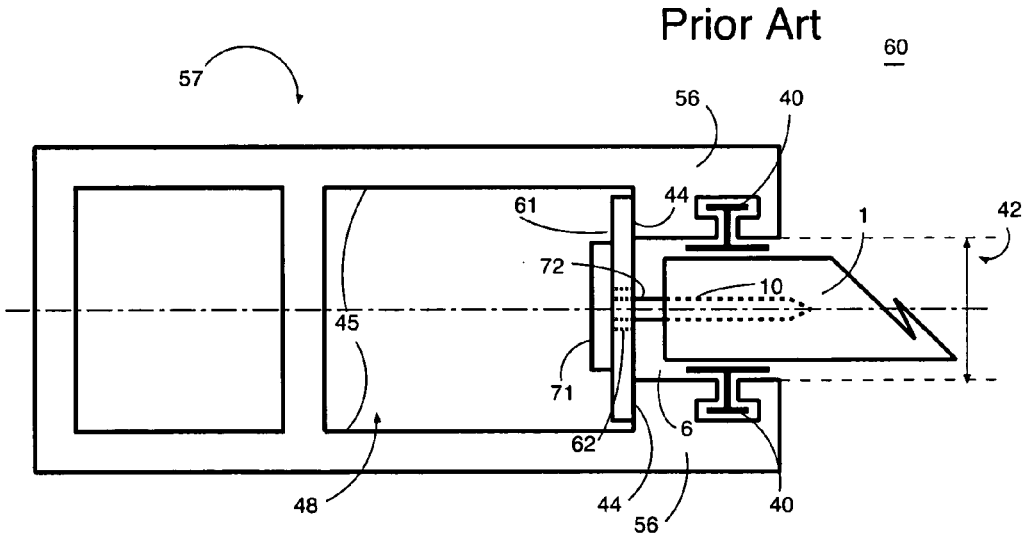
FIG. 8 is a detailed sectional view of a second prior art guide engaged by the shutter slat and the second prior art end retention system of FIG. 7.

A prior art end retention system 60 that eliminates the second retention fins 54 is shown in FIGS. 7 and 8. As shown in more detail in FIG. 7, the end retention system 60 includes a screw 70 and a washer 61. The washer 61 has an aperture 62 that is offset from the center of the washer 61, as shown. The screw 70 has a smooth shaft 72, a threaded shaft 74, and a head 71. The threaded shaft 74 is of a diameter about equal to the diameter of the screw boss receptacle 10 in the slat 1, such that the threaded shaft 74 may be screwed into and retained by the screw boss receptacle 10. The length of the smooth shaft 72 is about the same as depth of the washer 61 to allow the washer 61 to rotate with respect to the shaft 72. The diameter of the aperture 62 is about the same as the diameter of the smooth shaft 12 of the screw 8.

FIG. 8 is a detailed sectional view of a guide 57 engaged by the shutter slat 1 and the end retention system 60. The guide 57 may include end retention fins 56 that partially bound a first channel 48, where the end retention fins 56 are separated by a distance 42 that is greater than the width 28 of the profile of the shutter slat 1. The end retention fins 56 each include an inner retaining surface 44 that serves to retain the washer 61 within the first channel 48. The end retention fins 56 may also include weather strips 40. The retention system 60 may be coupled to the shutter slat 1 for use with the guide 57 by inserting the screw 70 into the boss receptacle 10.

The head 71 of the retention screw 70 and the washer 61 protrude from the boss receptacle 10 of the slat 1, and are able to move within the first channel 48 of the guide 57. The head 71 of the retention screw 70 retains the washer 61 to the shutter slat 1 because the head 71 of the screw 70 is wider than the aperture 62 of the washer 61. Consequently, because the outer diameter of the washer 61 is greater than the distance that separates the retention fins 56, the washer 61 is retained within the first channel 48, and the retention system 60 retains the shutter slat 1 within the guide 57.

The end retention system 60 allows the first retention fins 56, which may accommodate weather strips 40, to be the sole retention fins in the guide 57 (in other words, second retention fins 54 used in the first prior art end retention system shown in FIGS. 4-6 may not be required). This use of the first retention fins 56 as the only retention fins allows for an increase in the amount of slip as compared to the first prior art end retention system of FIGS. 4-6.

Figure 9:
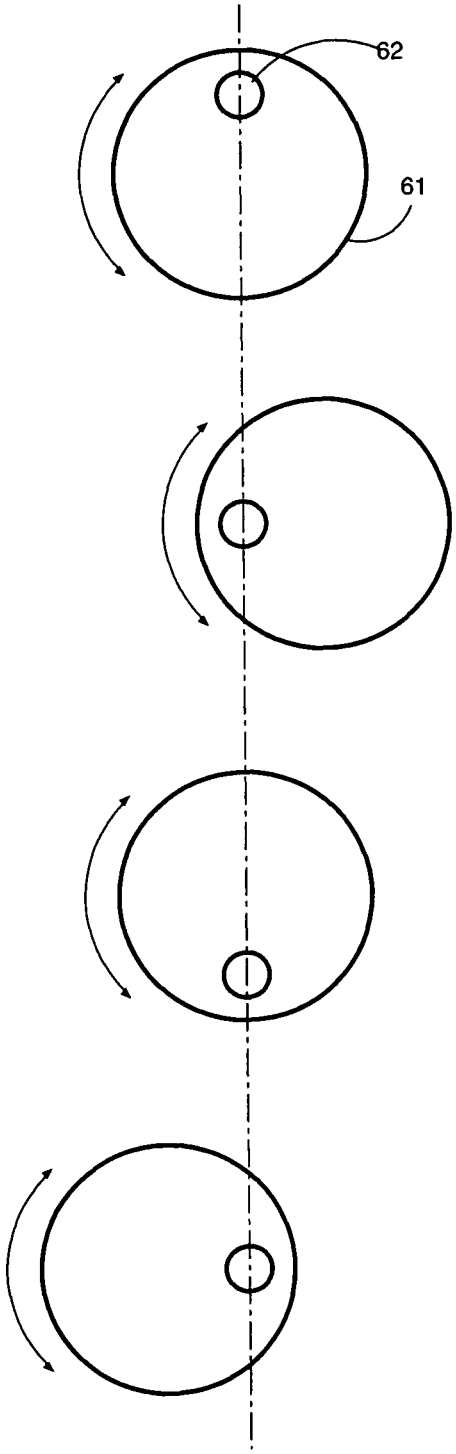
FIG. 9 shows a range of movement of the second prior art end retention system of FIG. 7 in a plane.

Nevertheless, the end retention system 60 causes operation of the shutter 20 to be loud, "jerky," vibration-prone, and energy inefficient. This is because the aperture 62 is offset with respect to the center of the washer 61, so that the washer 61 rotates in an undesirable "cam-like" manner around the screw 70, as shown in FIG. 9. This cam-like rotation results when the washer 61 comes in contact with the inner wall 45 of the guide 57 while the shutter 20 is opening or closing, which contact causes the washer 61 to roll on the wall 45. Because the prior art end retention system 60 is coupled to the slats 1 of the shutter 20, as the washer 61 rotates as shown in FIG. 9, the slats 1 are pushed "back and forth" in the guide 57, causing undesirable noise, vibration, and friction. Additionally, this motion may increases the torque required to raise the shutter 20, which translates into either more manual effort or a larger motor to raise the shutter curtain 20.

In order to provide an end retention system that does not require the second retention fins 54 and the extended screw shaft 53 as in the first prior art system 26, while avoiding the cam-like rotation of the second prior art system 60, a new design for an end retention system is shown in FIG. 10. FIG. 10 is a detailed side view of the two shutter slats 1*a* and 1*b* of FIG. 3 engaged with one another, and having an end retention system 3 installed. The end retention system 3 comprises a fastener (screw) 8 and a washer 9. It will be understood that the fastener 8 may be a rivet, a screw, a bolt, cast boss, or the like, even though the term "screw" is used herein to refer to this fastener 8 to simplify the disclosure. The use of the term "screw" is not intended to limit the claimed invention in any way, and the term "fastener" as used in the claims may refer to any structure that provides means for attaching the washer 9 to the slat 1. The screw 8 has a head 21, and may include a first shaft 12 and a second shaft 14.

Additionally, the term "washer" is used to describe a rounded object that includes at least one aperture through which the shaft of the screw 8 may pass. The rounded object may be oblong, circular, or may comprise part of a sphere or an ellipsoid. The aperture may or may not be centered in the object, and may or may not have a circular cross section. The use of the term "washer" herein and in the attached claims should be read to include all manner of rounded objects having an aperture that are capable of being coupled to the shutter slat 1 and moving within the guide 18.

Figure 11:
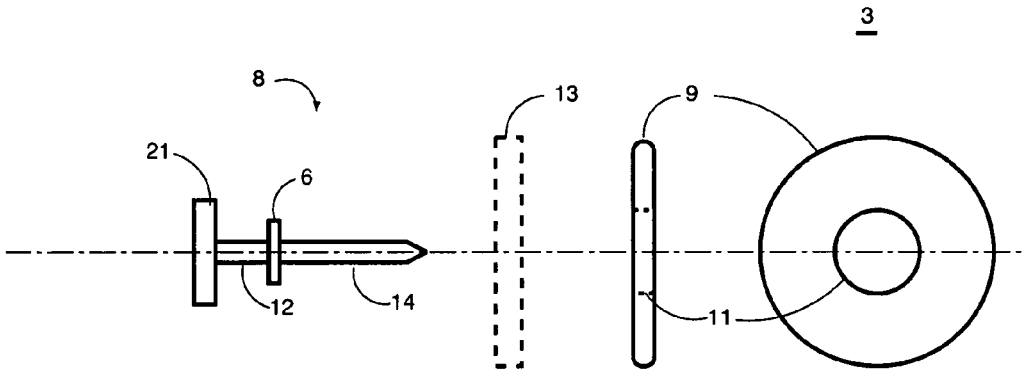
FIG. 11 is a detailed view of the end retention system of FIG. 10.
Figure 12:
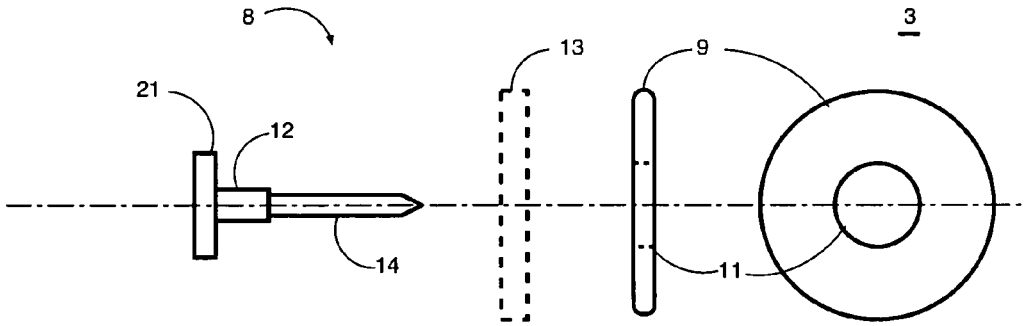
FIG. 12 is a detailed view of the end retention system of FIG. 10.

As shown in more detail in FIGS. 11 and 12, the end retention system 3 may include the screw 8 and the washer 9. Optionally, the end retention system 3 may include a spacer 13. As shown in FIG. 12, the screw 8 may comprise a smooth shaft 12, a threaded shaft 14, and a head 21. As shown in FIG. 11, the screw 8 may additionally comprise a lip 6. The threaded shaft 14 is of a diameter about equal to the diameter of the screw boss receptacle 10 in the slat 1, such that the threaded shaft 14 may be screwed into and retained by the screw boss receptacle 10. The lip 6 may create a dimension that enables the screw 8 to retain the slat 1*b* from sliding side-to-side with respect to slat 1*a*. In this manner, the lip 6 may help to keep the shutter curtain 20 aligned.

The smooth shaft 12 may have a diameter that is greater than the diameter of the threaded shaft 14 (for example, about the diameter of the threads), in which case the smooth shaft 12 can be used as a positive stop. The smooth shaft 12 may alternatively have a diameter large enough to retain the slat 1*b* from slipping side to side with respect to slat 1*a*; for example, the smooth shaft 12 may have a diameter that is about the same as the diameter of the lip 6, in which case a lip 6 would not be needed. The length of the smooth shaft 12 may be greater than depth of the washer 9 to accommodate free rotation of the washer 9. Preferably, the smooth shaft 12 has diameter that is small enough to provide for the free movement of the washer 9 on the shaft 12. The shaft 12 may have a length to accommodate side-to-side movement of the washer 9, in order to ease displacement of the washer 9 if it comes in contact with an adjacent washer 9 when the roller shutter 20 is rolled up. This length will also accommodate the rotation while the washer 9 is fully engaged with the guide 18.

Regarding the washer 9, a linear dimension of the aperture 11 (such as a diameter or an axis of the aperture 11) may be about twice the diameter of the shaft 12 of the screw 8, as will be further explained below. Also, the linear dimension of the aperture 11 (such as a diameter or an axis of the aperture 11) may about three, four, five, or six times the diameter of the shaft 12 of the screw 8. In a preferred embodiment, the outer edge of the washer 9 has a profile that is substantially circular, and the aperture 11 has a profile that is substantially circular, and the profile of aperture 11 is substantially concentric with the profile of the outer edge of the washer 9. The outer edge of the washer 9 may be beveled (convex), as shown, so that if it happens to contact another washer 9 when the roller shutter 20 is rolled up, the washer 9 can easily slide past the contacted washer 9. Alternatively, the outer edge of the washer 9 may be flat, or even concave.

The spacer 13 may be a neoprene spacer or washer having substantially the same profile as the washer 9. The thickness of the spacer 13 may be greater than, substantially the same as, or less than, the thickness of the washer 9, depending on how much longer the shaft 12 is than the width of the washer 9. Additionally, the spacer 13 may be a spring or other resilient material or device capable of compression under a load. The spacer 13 may be located on either side of the washer 9, and is preferable located between the washer 9 and the slat 1. One purpose for the optional spacer 13 is to suppress "rattling" of the washer 9 in the guide 18 as the shutter 20 is being raised and lowered.

Figure 13:
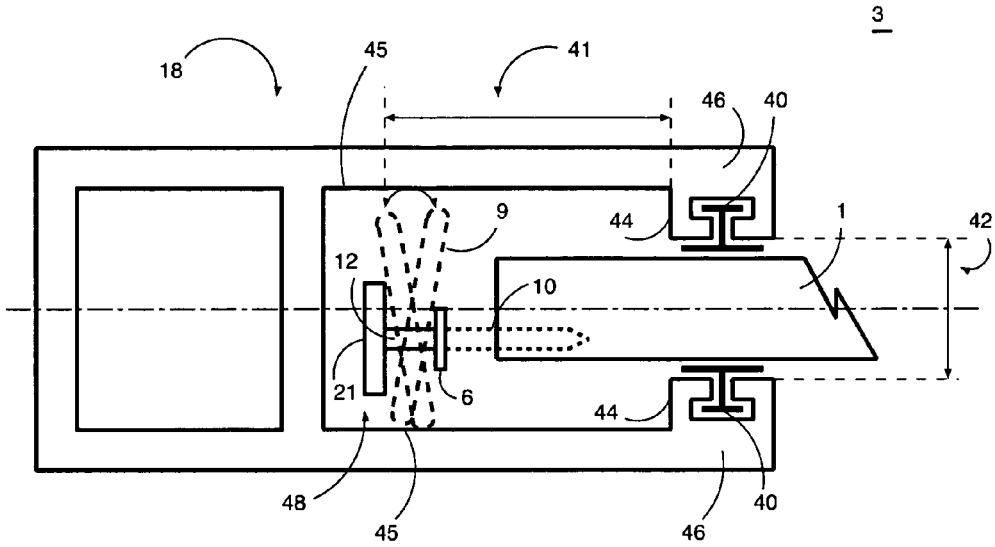
FIG. 13 is a detailed sectional view of the guide of FIG. 1 engaged by the shutter slat and end retention system of FIG. 10, where the shutter slat is in a first position.
Figure 14:
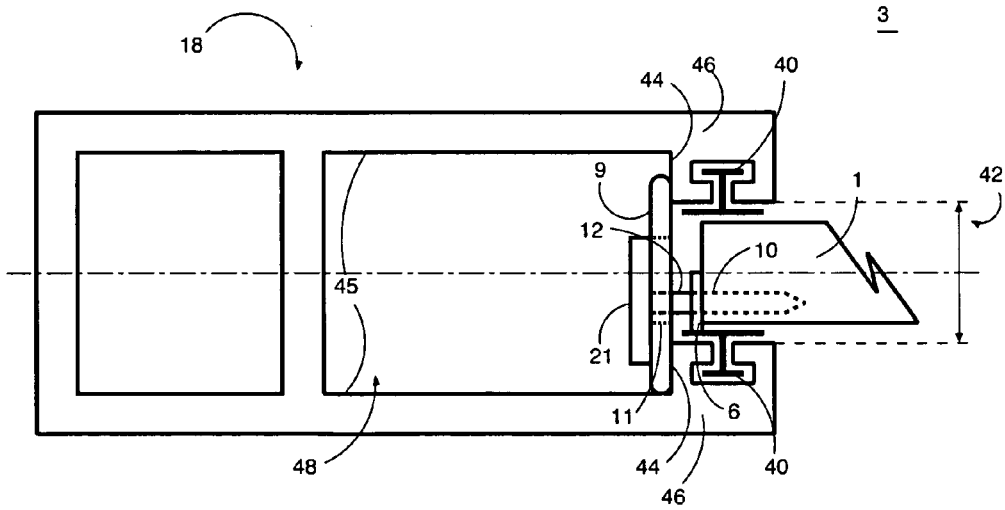
FIG. 14 is a detailed sectional view of the guide of FIG. 1 engaged by the shutter slat and end retention system of FIG. 10, where the shutter slat is in a second position.

FIG. 13 is a detailed sectional view of the guide 18 engaged by the shutter slat 1 and the end retention system 3, where the shutter slat 1 is in a first horizontal position. For example, the shutter slat 1 may be in the first horizontal position when it is being raised or lowered, or is otherwise not subject to catenary forces established when the shutter 20 is put under load. FIG. 14 is a detailed sectional view of the guide 18 engaged by the shutter slat 1 and the end retention system 3, where the shutter slat 1 is in a second horizontal position. For example, the shutter slat 1 may be in the second horizontal position when it is subject to catenary forces established when the shutter 20 is put under load by wind, would-be intruders, or the like. As shown in FIGS. 13 and 14, the shutter slat 1 is enabled to slide between the first and second horizontal positions. In FIGS. 13 and 14, the screw 8 is shown including the lip 6, but the lip 6 may be omitted without changing the operation of the end retention system 3 as described herein, and omission of the lip 6 is not intended to limit the claimed invention in any way.

Referring to FIGS. 13 and 14, the guide 18 may include end retention fins 46 that partially bound a first channel 48, where the end retention fins 46 are separated by a distance 42 that is greater than the width 28 of the profile of the shutter slat 1. The end retention fins 46 each include an inner retaining surface 44 that serves to retain the washer 9 within the first channel 48. The end retention fins 46 may also include channels for weather strips 40. The channels for weather strips 40 in the end retention fins 46 may be substantially c-shaped, as shown, or could be substantially u-shaped, or v-shaped. The retention system 3 may be coupled to the shutter slat 1 for use with the guide 18 by inserting the screw 8 into the boss receptacle 10.

The head 21 of the retention screw 8 and the washer 9 protrude from the boss receptacle 10 of the slat 1, and are able to move within the first channel 48 of the guide 18. The head 21 of the retention screw 8 retains the washer 9 to the shutter slat 1 because the head 21 of the screw 8 is wider than the aperture 11 of the washer 9. Consequently, because the outer diameter of the washer 9 is greater than the distance that separates the retention fins 46, the washer 9 is retained within the first channel 48, and the retention system 3 retains the shutter slat 1 within the guide 18.

The end retention system 3 shown in FIGS. 10-16 is a simple system that facilitates maximum desirable engagement with the guide 18 while enabling smooth movement of the end retention system 3 within the guide 18. The end retention system 3 may center itself between the inner walls of the guide 18, and the washer 9 may be able to reposition itself if it comes in contact with an adjacent washer 9 when the shutter curtain 20 is rolled into the shutter casing 17. The end retention system 3 is desirable because it is very simple, yet accommodates movement in many planes (as shown in FIGS. 10-16), and allows for free rotation of the washer 9.

The end retention system 3 allows the first retention fins 46, which may accommodate weather strips 40, to be the sole retention fins in the guide 18 (in other words, second retention fins 54 used in the prior art end retention system of FIGS. 4-6 may not be required). This use of the first retention fins 46 as the only retention fins allows for an increase in the amount of slip as compared to the prior art end retention system of FIGS. 4-6. Additionally, the guide 18 is capable of providing as much retention strength as the prior art guide 43, while using less material, which decreases the overall system cost. The end retention system 3 also allows for the use of the less complex guides 18, which further decreases the system cost. Because the guide 18 does not need of the additional cavity required on most end retention systems, and the guide 18 facilitates more desired slip for a given width of guide.

The end retention system 3 is well suited for use where the screw boss receptacle 10 of the slat 1 is not on the centerline of the profile of the slat 1, and therefore likely not on the centerline of the guide 18, enabling the use of the end retention system 3 with thin slats, such the illustrative slats 1. For example, in a single-walled (thin) slat such as slat 1, the screw boss receptacle 10 may be off center.

The end retention system 3 allows the washer 9 to be centered in the track 18, because the screw 8 can position itself toward one side of the aperture 11 of the washer 9. Another advantage of the end retention system 3 is that the washer 9 may rotate freely if it engages an inner side wall 45 of the guide 18 when moving up or down. Furthermore, the washer 9 of the end retention system 3 may be attached very close to, or touching, the ends 15, 16 of the slat 1, thereby reducing the likelihood of the problems described above when a moment is applied to the screw 8. The end retention system 3 is desirable because it is very simple and accommodates movement in many planes and provides free rotation of the washer 9.

Figure 15:
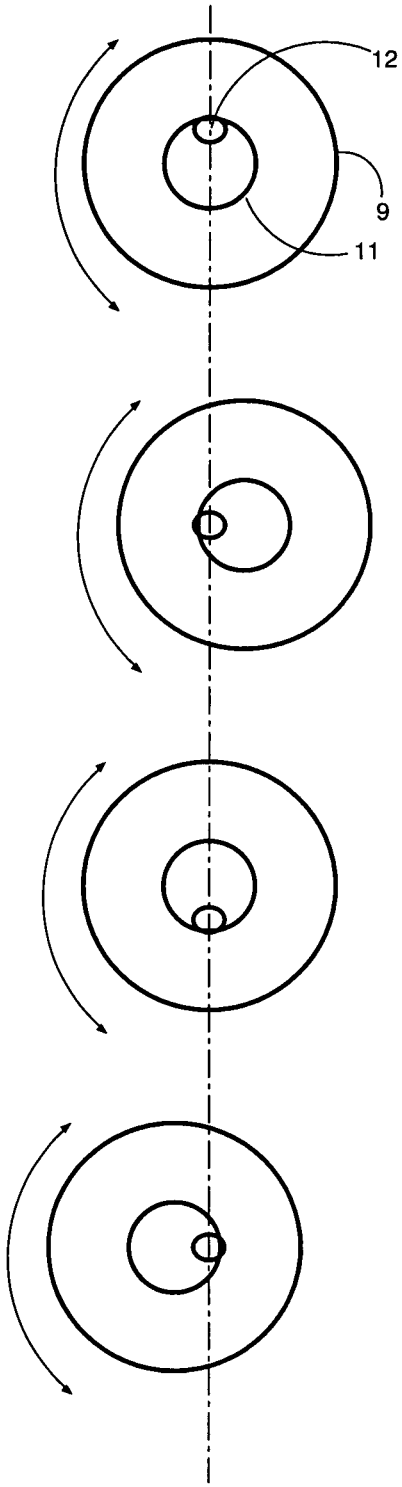
FIG. 15 shows a range of movement of the end retention system of FIG. 10 in a plane.

FIG. 15 shows a range of movement of the washer 9 of the end retention system 3 in a plane. As shown, the washer 9 has the ability for free rotation about the shaft 12. As the end retention system 3 travels up and down the guide 18, the washer 9 may rotate and move relative to the shaft 12 as shown, depending on the forces applied to the shaft 12 at any given time. The size of the aperture 11 allows for the shaft 12 to remain aligned with the guide 18 (shown in FIGS. 11 and 12) as the washer 9 moves within the guide 18. As shown in FIG. 15 with the illustrative washer 9, the forced "back-and-forth" movement of the sofit 12 with respect to the wall 45 of the guide 18 is minimized or eliminated.

Figure 16:
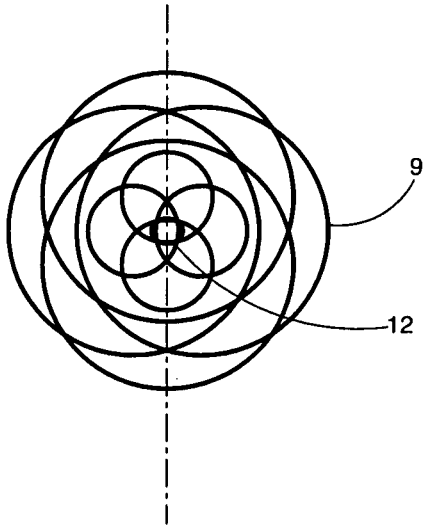
FIG. 16 shows a range of movement of the end retention system of FIG. 10 in a plane.

FIG. 16 shows the full range of movement of the washer 9 on a plane perpendicular to the shaft 12, and the ability for rotation of the washer 9 in the plane. As shown in FIG. 16, the end retention system 3 provides for an increased range of motion and rotation when compared to the prior art end retention systems. Additionally, the shaft 12 is not moved "off center" as the washer 9 moves in the plane, so that the shutter 20 is able to be smoothly raised and lowered in the guides 18.

Modifications in addition to those described above may be made to the structures and techniques described herein without departing from the spirit and scope of the invention. Accordingly, although specific embodiments have been described, these are examples only and are not limiting on the scope of the invention.

The invention claimed is:

1. An end retention system for a rolling shutter assembly, the system comprising:

a guide track having a length;

a slat having two ends, a first edge and a second edge, and a profile width;

a means at one end of the slat for attachment of a fastener, the entire profile of the slat end configured to be retained by the guide track, and to travel along the length of the guide track, the guide track having a lengthwise cross-section comprising a channel having a channel width, a channel depth, and an opening in the channel width, the opening defined by first and second retention fins spaced an opening distance apart, the opening distance sufficient to accommodate the entire profile of a slat end so as to allow the slat end to travel the length of the guide track in the opening, the end retention device comprising:

a fastener capable of being attached to the slat end, the fastener comprising a shaft, having a shaft diameter and a shaft length, wherein the shaft extends for the shaft length from the slat end when the fastener is attached to the slat end, and a head having a head width attached to an end of the shaft distal from the slat end;

a freely rotatable washer, the washer having an outer diameter greater than the profile width and smaller than the channel width, the washer comprising an inner aperture having a diameter that is at least twice the shaft diameter but smaller than the head width, wherein the shaft is disposed within the inner aperture of the washer such that the washer is capable of sliding along the shalt length, canting about an axis perpendicular to the shaft length, and moving perpendicular to the shaft length when the fastener is attached to the slat end;

wherein the head and the washer are disposed in the channel of the guide track when the slat end having an end retention device is retained in the opening of the guide track, and wherein the slat engages other identical slats and conforms to a roll inside a shutter casing, wherein the washer moves about the shaft such that the washer repositions itself when contacted washer on another identical slat when conformed to a roll.

2. The end retention system of claim 1 wherein the diameter of the aperture is at least four times the shaft diameter.

3. The end retention system of claim 1 wherein the first and second retention tins each comprise an inner retaining surface, wherein the inner retaining surfaces retain the washer within the channel.

4. The end retention system of claim 1 wherein the channel has a depth, and the washer is movable across the depth of the channel.

5. The end retention system of claim 1 wherein the fastener is a screw.

6. The end retention system of claim 1 wherein the fastener is a bolt.

7. The end retention system of claim 1 wherein first retention fin comprises a surface that faces the second retention fin and partially hounds a weather-strip channel within the first retention fin.

8. The end retention system of claim 1, further comprising spacer that fits around the shaft, the spacer having a spacer diameter greater than the inner diameter of the washer.

9. The end retention system of claim 8, wherein the spacer is interposed between the head and the washer.

10. The end retention system of claim 8, wherein the spacer comprises a spring or a compressible material, and wherein the spacer is capable of being compressed along the first shaft.

11. The end retention system of claim 1, wherein the means of attachment on the slat end is a receptacle, and the shaft diameter is about equal to a diameter of the receptacle.

12. The end retention system of claim 1, wherein the fastener further comprises a threaded shaft that is collinear with the shaft, the threaded shaft configured to be screwed into the fastening means of the slat.

13. The end retention system of claim 1, wherein the washer has a beveled edge.

14. A rolling shutter assembly comprising:

a curtain comprising a plurality of engaging slats that engage one another, each slat having a first end and a second end, a first edge and a second edge, and a profile width;

a guide track in which the first ends of the plurality of engaging slats travel as the curtain is moved across a building opening by an operator, the guide track having a lengthwise cross-section comprising a channel having a channel width, a channel depth, and an opening in the channel width, the opening defined by first and second retention fins spaced an opening distance apart, the opening distance sufficient to accommodate a slat end so as to allow the first ends of the engaging slats to travel the length of the guide track in the opening, wherein a plurality of slats each have a first end comprising an end retention device, each end retention device comprising:

a fastener attached to the first end of the slat, the fastener comprising a shaft having a shaft diameter and a shaft length, wherein the shaft extends for the shaft length from the end of the slat into the channel, and a head having a head width at the end of the shaft away from the first end, the head disposed in the channel;

a freely rotatable washer disposed inside the channel and around the shaft, the washer having an outer diameter greater than the profile width and less than the channel width, and comprising an aperture having an inner diameter that is at least twice the shaft diameter but smaller than the head width, the aperture of the washer disposed around the shaft such that the washer is capable of sliding along the shaft length, canting about an axis perpendicular to the shaft length, and moving perpendicular to the shaft length when the fastener is attached to the slat end;

wherein the head and washer are disposed in the channel of the guide track when the slat end having an end retention device is retained by the guide track, further comprising a shutter casing in which the curtain is rolled when the shutter is retracted, wherein the washers of the end retention devices move about the respective shafts such that the washers reposition themselves when contacted by one another when the curtain is rolled.

15. The shutter assembly of claim 14 wherein the diameter of the aperture is at least four times the shaft diameter.

16. The shutter assembly of claim 14 wherein the first and second retention fins each comprise an inner retaining surface, wherein the inner retaining surface retains the washer within the channel.

17. The shutter assembly of claim 14 wherein the channel has a depth, and the washer is movable across the depth of the channel.

18. The shutter assembly of claim 14 wherein the fastener is a screw.

19. The shutter assembly of claim 14 wherein the fastener is a bolt.

20. The shutter assembly of claim 14 wherein first retention fin comprises a surface that faces the second retention fin and partially bounds a weather-strip channel within the first retention fin.

21. The shutter assembly of claim 14, further comprising a spacer that fits around the shaft, the spacer having a spacer diameter greater than the inner diameter of the washer.

22. The shutter assembly of claim 21, wherein the spacer is interposed between the head and the washer.

23. The shutter assembly of claim 21, wherein the spacer comprises a spring or a compressible material, and wherein the spacer is capable of being compressed along the first shaft.

24. The shutter assembly of claim 14, wherein the shaft diameter is about equal to a diameter of the screw boss receptacle of the slat.

25. The shutter assembly of claim 14, wherein the fastener further comprises a threaded shaft that is collinear with the shaft, the threaded shaft configured to be screwed into the receptacle.

26. The shutter assembly of claim 14, wherein the washers have beveled edges.

* * * * *